United States Patent [19]

Twilley et al.

[11] Patent Number: 4,507,361

[45] Date of Patent: Mar. 26, 1985

[54] LOW MOISTURE ABSORPTION BRISTLE OF NYLON AND POLYESTER

[75] Inventors: Ian C. Twilley, Chester; Garland L. Turner, Chesterfield; Peter R. Saunders, Richmond, all of Va.; John C. Haylock, Sparta, N.J.

[73] Assignee: Allied Corporation, Morris Township, Morris County, N.J.

[21] Appl. No.: 514,711

[22] Filed: Jul. 18, 1983

[51] Int. Cl.[3] ..... D02G 3/00

[52] U.S. Cl. ..... 428/373; 428/364; 428/401; 15/159 R; 15/159 A

[58] Field of Search ..... 428/364, 373, 401; 15/159 R, 159 A; 525/425

[56] References Cited

U.S. PATENT DOCUMENTS

| | | | |
|---|---|---|---|
| 3,522,342 | 7/1967 | Nungesser et al. | 15/159 A |
| 3,618,154 | 12/1971 | Muhler et al. | 15/159 A |
| 3,944,708 | 3/1976 | Dumas | 428/400 |
| 4,355,489 | 10/1982 | Heyer et al. | 51/400 |
| 4,409,372 | 9/1983 | Ward et al. | 428/364 |

*Primary Examiner*—George F. Lesmes
*Assistant Examiner*—Beverly K. Johnson
*Attorney, Agent, or Firm*—Patrick L. Henry; Richard A. Negin

[57] ABSTRACT

A bristle material is disclosed having improved stiffness, and comprised of a thermoplastic matrix comprising a blend of nylon and polyester and containing an abrasive filler.

9 Claims, No Drawings

LOW MOISTURE ABSORPTION BRISTLE OF NYLON AND POLYESTER

BACKGROUND OF THE INVENTION

The present invention relates to bristles having an abrasive filler. More particularly, it relates to abrasive bristles of the type disclosed in U.S. Pat. No. 3,522,342. This patent discloses a method for making a bristle material comprised of a thermoplastic matrix and an abrasive filler material dispersed therein. Amongst the thermoplastics that are disclosed are nylon and combinations of nylon and a polyester. While the bristles that are predominately nylon are generally stiff and abrasive, in applications where they are exposed to hot water their stiffness (expressed as tensile modulus) tends to suffer because of water absorption.

SUMMARY OF THE INVENTION

The present invention relates to a bristle material having a diameter of about 0.02 inch to about 0.09 inch and comprised of a mixture of about 10 to about 30 weight percent of a polyamide based on the total thermoplastic weight, the polyamide preferably having less than about 35% of its end groups being amine groups, and about 70 to about 90 weight percent of poly(ethylene terephthalate) (PET), having an intrinsic viscosity of at least about 0.60 in the bristle; and preferably including an abrasive filler being present in an amount of about 5 to about 50 weight percent based on weight of the filled bristle.

DETAILED DESCRIPTION

The bristle material of the present invention comprises generally a blend of polyamide, and a poly(ethylene terephthalate) having relatively high intrinsic viscosity (I.V.) in the bristle of at least about 0.60.

As used herein, the term "polyamide" is intended to include long chain synthetic polymers which have regularly recurring amide groups as an integral part of the main polymer chain. Suitable polyamides can be prepared by polymerization of difunctional monomer or equivalently, cyclized lactam (e.g., epsilon-aminocaproic acid or caprolactam, respectively) or by the reaction of a conjugate pair of monomers, for example, a diamide and a dicarboxylic acid (e.g., hexamethylenediamine and adipic acid), or a linear aminoaliphatic acid such as omega-aminoundecanoic acid.

Suitable polycaprolactam can be produced by the polymerization of lactam monomers of the formula

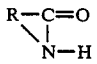

where R is an alkylene group having from 3 to 12 or more carbon atoms, preferably from 5 to 12 carbon atoms. A preferred monomer is epsiloncaprolactam having 5 carbon atoms in the alkylene group. Lactam monomers in addition to epsiloncaprolactam include pyrollidone, piperodone, valerolactam, caprylactam, lauryllactam, etc. Also included are copolymers of two or more of the above or simlilar lactam monomers. Suitable diamines useful in the polymerization of polyamides include propanediamine, hexamethylenediamine, octamethylenediamine, etc. Suitable polycarboxylic acids include acids such as adipic acid, pimelic, suberic, sebacic, dodecanoic, etc. Also included are copolymers or blends of polyamides of the above two categories.

Polyamides useful in the composition of the present invention preferably are polyepsiloncaprolactam (nylon 6), polyhexamethyleneadipamide (nylon 6/6), or mixtures thereof.

Typically, the number average molecular weight of these polymers is between about 10,000 and about 50,000, preferably about 15,000 to about 40,000, and more preferably about 20,000 to about 30,000. The properties improve rapidly at about 20,000 and processing starts becoming more difficult after about 30,000.

Polyepsiloncaprolactam or polyhexamethyleneadipamide suitable for use herein can contain a variety of terminal functionality. The preferred polyepsiloncaprolactam or polyhexamethylene adipamide preferably does not have above about 35% of its end groups being amine groups in order to reduce chemical reactivity with the poly(ethylene terephthalate). Monocarboxylic acids or dicarboxylic acids, including acetic, azelaic, sebacic, or terephthalic acids, can be used to reduce the level of the amine end groups to 35% preferably less than about 25%, of the total end groups of the polymer.

The poly(ethylene terephthalate) (PET) used herein is preferably derived from the polycondensation of terephthalic acid and ethylene glycol, but may be derived from other well known raw materials. The PET has an intrinsic viscosity (I.V.) ranging between about 0.60 and about 0.85, in the bristle with a preferred I.V. ranging between about 0.75 and about 0.85. Intrinsic viscosity is obtained by extrapolation of viscosity values to zero concentration of solutions of poly(ethylene terephthalate) in a 60 to 40 weight/volume ratio of phenol and tetrachloroethane. The measurements are made at 25° C. The PET melts between about 250° C. and about 275° C. The poly(ethylene terephthalate) can contain minor amounts, up to about 5 percent, of other comonomers such as 1,4,cyclohexyldimethyldiol, butyldiol, neopentyldiol, diethylene glycol, or glutaric acid.

The I.V. specified is of the poly(ethylene terephthalate) in the bristle material itself, not of the polymer being fed to the extruder. If the I.V. is below about 0.60, the physical properties of the bristle will deteriorate rapidly. To achieve this viscosity in the bristle, the polymer fed to the extruder should have a viscosity of at least about 0.85. In this respect, it is also important that the poly(ethylene terephthalate) resin, the abrasive, and the nylon being fed to the extruder, be kept relatively dry to prevent deterioration of the I.V. by hydrolysis of the poly(ethylene terephthalate) as it is being extruded. Likewise, it is important that the level of amine groups in the polyamide be controlled as specified above so as to prevent chemical reactivity with the poly(ethylene terephthalate) and further deterioration of the properties.

The abrasive fillers usable include silicon carbide aluminum oxide, asbestos particles, diamond particles ceramic particles, etc. The preferred range of filler in the final product is from about 1 to about 50 percent by weight of the bristle, preferably about 20 to about 30 percent.

The present process is particularly useful in preparing abrasive filled thermoplastics wherein the abrasives have a hardness value, as rated by the Knoop Scale, greater than about 80 and preferably greater than about 1,000. The Knoop Scale values are determined by measuring the indentation resulting when a weighted diamond pyramid penetrates the test material. Thus, the hardness value is expressed as the load in kilograms divided by the projected area in square millimeters.

In addition to the aforementioned hardness, the abrasives found most useful were those which will pass through a screen size about 10 to about 1,500 mesh, preferably about 80 to about 500. Accordingly, the abrasive filler may be aluminum oxide and silicon carbide each having a grit size ranging from about 10 to about 1,500 mesh, preferably about 80 to about 500, and a hardness value of about 1,250 to about 1,750 for aluminum oxide and about 2,130 to about 2,500 for silicon carbide, or the abrasive diamond dust having a grit size of about 80 to about 320 and a hardness value of about 5,500 to about 6,950. Although aluminum oxide, silicon carbide and diamond dust are the preferred abrasive fillers, other abrasives having the aforementioned hardness and grit sizes can be utilized. Representative examples of other abrasives employable in the present process are boron carbide, tungsten carbide, tantalum carbide, and the like.

The extruded bristles may be produced by the process described in U.S. Pat. No. 3,522,342, the disclosure of which is hereby incorporated herein by reference. The total stretch imparted to the bristles is approximately 2 to 4 times their original length.

This stretching results in superior tensile modulus and bend recovery.

The bristle products of the present invention are in the form of a rod or tube having a wide variety of cross-sectional configurations and has a diameter from about 0.02 inch to about 0.09 inch, preferably 0.02 inch to 0.075 inch.

The extruded products of the present invention may be cut into unit lengths, such as about 5 to about 10 inches, thereby forming bristles which can be utilized in making abrasive wheels. The unit lengths may also be about 2 to about 3 feet long for use in making brooms.

Surprisingly, it has been found that when a polyamide, and PET having an I.V. of about 0.60 to about 1.00, are combined in amounts of 10–30% polyamide and 70–90% PET, the resulting bristle has stiffness expressed as Tensile Modulus superior to that of the nylon alone and the Bend Recovery is superior to that of the PET alone, thus providing on balance a product with acceptable bend resistance and superior stiffness relative to nylon.

The thermoplastic matrix should comprise a mixture of about 10 to about 30 weight percent of nylon preferably about 10 to about 20 weight percent, based on the total thermoplastic weight and about 70 to about 90 weight percent, preferably about 80 to about 90 weight percent of PET.

If the polyester is present in concentrations below about 70%, the integrity of the polyester matrix, vis-a-vis the nylon dispersed phase is lost, and poor mechanical properties result. If the nylon is present in concentrations of less than about 10%, the Bend Recovery worsens significantly.

EXAMPLES

The following examples are exemplary of the present invention:

Example 1

A strand of bristle material comprising a blend of 85% PET having an initial I.V. of about 0.85, and 15% nylon 6 having 20–23% amine end groups were extruded from a 0.75 inch diameter extruder having an L/d of about 24/1. This material was drawn to the point where the bristle material had a drawn diameter of 0.010 inches. The Bend Recovery and the Tensile Modulus, tested Dry and Wet, were as follows:

| DRY 20° C. - 65% RH | | HOT WET(1) | |
|---|---|---|---|
| TM(2) (gpd) | Bend(3) Recovery | TM(2) (gpd) | Bend(3) Recovery |
| 55 | 65% | 26 | 80% |

(1)Hot Wet conditions are simulated by immersing samples in boiling water for 15 minutes, then testing after removing from the water.
(2)TM = Tensile Modulus which is determined by the method described in ASTM-D885, immediately after removing from the water, in the case of hot wet conditions.
(3)Bend Recovery is a test in which the bristle material is coiled 10 times around 0.25 inch diameter mandrel, placed in water for 1 hour at room temperature, and then slid off the mandrel and allowed to sit for 1 hour period during which time the coils tend to expand. After the 1 hour period, the remaining coils are counted. The number of coils remaining (N) is used to determine Percent Bend Recovery (BR) according to the following formula:
BR = (10 - N)10
(In the case of "Hot Wet" conditions, the strand is allowed to cool to room temperature before subjecting it to the BEND Recovery Test.)

Example 2

Repeat Example 1 but include in the bristle material, 24% by weight of silicon carbide based on the total weight of the bristle.

Example 3

Repeat Example 1 but use 75% PET and 25% nylon 6.

Example 4

Repeat Example 3 but use 20 weight percent aluminum oxide based on the total weight of the bristle.

While exemplary embodiments of the invention have been described, the true scope of the invention is to be determined from the following claims.

What is claimed is:

1. A bristle material having a diameter of about 0.02 inches to about 0.09 inches and comprising a thermoplastic matrix and an abrasive filler material dispersed therein;

(a) said thermoplastic matrix comprising a mixture of about 70 to about 90 weight percent of a poly(ethylene terephthalate), having an intrinsic viscosity of at least about 0.60, based on the total thermoplastic weight, and about 10 to about 30 weight percent of polyamide having less than 35% of its end groups being amine groups; and (b) said abrasive filler being present in an amount of about 2 to about 50 weight percent based on the total weight of the bristle.

2. The bristle material of claim 1 wherein the polyamide is nylon 6.

3. The bristle material of claim 2 wherein the nylon 6 has less than 25% of its end groups being amine groups.

4. The bristle material of claim 1 wherein the polyamide is present in an amount varying from about 10 to about 20 weight percent and the poly(ethyleneterephthalate) is present in an amount varying from about 80 to about 90 weight percent.

5. The bristle material of claim 4 wherein the abrasive material has a Knoop Scale hardness of greater than 1,000, is present in concentrations ranging from 20 to 35 percent based on the weight of the filled bristle and has a grit size passing through a screen size of 10 to 1,500.

6. The bristle material of claim 5 wherein the abrasive material has a grit size passing through a screen size of about 80 to about 500 mesh.

7. The bristle material of claim 6 wherein the abrasive material is silicon carbide and has a Knoop Scale hardness of 2130 to 2500.

8. The bristle material of claim 5 wherein the bristle material has a diameter of about 0.02 inches to about 0.06 inches.

9. The bristle material of claim 8 wherein the abrasive material is aluminum oxide.

* * * * *